United States Patent [19]

Alexander et al.

[11] 4,229,834

[45] Oct. 28, 1980

[54] NECKWEAR CONSTRUCTION

[75] Inventors: Norman R. Alexander, Chappaqua, N.Y.; Harold F. Sutton, Albemarle, N.C.

[73] Assignee: Ack-Ti-Lining, Inc., New York, N.Y.

[21] Appl. No.: 10,376

[22] Filed: Feb. 8, 1979

[51] Int. Cl.[3] ..... A41D 25/06

[52] U.S. Cl. ..... 2/146

[58] Field of Search ..... 2/146, 144, 147, 155; 139/413

[56] References Cited

U.S. PATENT DOCUMENTS

| | | | |
|---|---|---|---|
| 1,528,453 | 3/1925 | Recher | 2/146 X |
| 1,792,453 | 2/1931 | Thomas | 139/413 |
| 1,827,313 | 10/1931 | Friedman | 2/146 |
| 2,204,094 | 6/1940 | Meier | 139/413 |
| 3,426,360 | 2/1969 | Ackerman | 2/146 |
| 3,562,814 | 2/1971 | Ackerman | 2/146 |
| 3,824,627 | 7/1974 | Schow et al. | 2/146 |

*Primary Examiner*—H. Hampton Hunter

*Attorney, Agent, or Firm*—Paul and Paul

[57] ABSTRACT

Neckwear is disclosed having a fabric casing folded longitudinally and a highly resilient single lining which is fabricated of double woven material.

5 Claims, 4 Drawing Figures

NECKWEAR CONSTRUCTION

BACKGROUND OF THE INVENTION a. Field of the Invention

The present invention refers to neckwear including neckties, scarfs, and the like. Also contemplated is other apparel fabricated of single interwoven double cloth fabric in combination with a fabric casing.

b. Prior Art Statement

There have been a number of attempts to improve upon the characteristics of neckties by incorporating linings of various types into various types of necktie casings. The prior art teachings relating to necktie linings and neckwear construction are summarized in patents assigned to Collins & Aikman, namely, U.S. Pat. Nos. 3,426,360 and 3,562,814. The necktie linings and neckwear construction therein represent improvements over the prior art and are directed to composite linings having two layers which are substantially contiguous and are secured together, preferably over their entire mutually coextensive area.

While the aforementioned patents directed to composite or double layer linings represent improvements over single layer linings and linings made up of overlapped layers, such improvements have been offset by disadvantages which include: a substantial increase in time in the laying-out and spreading of the double layer linings; an increase in difficulty in the cutting of the double layer linings since they tend to present a yielding, non-rigid surface to the cutting knife, thus increasing the difficulty and resistance of the knife in the cutting operation; difficulty in inserting and incorporating the double layer linings into the tie casing; and inherent disadvantages associated with the turning operation in the manufacture of the tie, such as frayed edges.

One attempt to eliminate the above disadvantages incorporates the idea of fabricating a tie without the use of tie linings. The tie is made with a double face fabric which is made of a single initial woven component comprising two textile layers joined to each other by means of binding wefts. Such a construction is found in U.S. Pat. No. 3,824,627. This type of approach, however, suffers from the many disadvantages inherent in failing to utilize tie casings in combination with tie linings. For example, tie linings enhance the final product in its hand, stretch, and knotting characteristics, ability to provide satisfactory bulk and body, and ability to satisfy the public by permitting the utilization of various materials and styles.

SUMMARY OF THE INVENTION

The aforementioned disadvantages are overcome by the present invention which utilizes a highly resilient single interwoven double cloth fabric as lining in neckwear construction.

One object is to provide in neckwear construction, a light-weight, single interwoven double cloth fabric which has excellent resiliency and improved hand, stretching, and knotting characteristics.

Another object is to provide in neckwear construction, a single interwoven double cloth fabric which has excellent napping characteristics and may be heavily napped on its outer surfaces to yield a roundness to the edges and fullness to the fabric not similarily achieved by conventional double linings.

A further object of the present invention is to provide neckwear with vastly superior knotting ability and recovery properties relative to producing the size knot demanded in the market place.

It is still a further object of the present invention to provide a durable interlining which is extremely economical to use in the manufacture of neckwear, reduces lay-out and spreading time, reduces the cutting operation of the tie lining, has ease of insertion into the necktie casing and thus the inherent benefit of easing the stitching operation, has the advantage of reducing fraying of the edges when the tie is turned, and will result in a better finished necktie since there will be no separation of interlinings as in the case of double cloth interlinings, and thus has the inherent benefit of eliminating a sloppy finished necktie due to the interlining being too full for the outer material or tie casing.

Other objects and advantages of the present invention will be readily apparent upon a reading of the following brief descriptions of the drawing figures, detailed description of the preferred embodiments, and the appended claims.

DETAILED DESCRIPTION OF THE PREFERRED EMBODIMENTS

Figure 1:
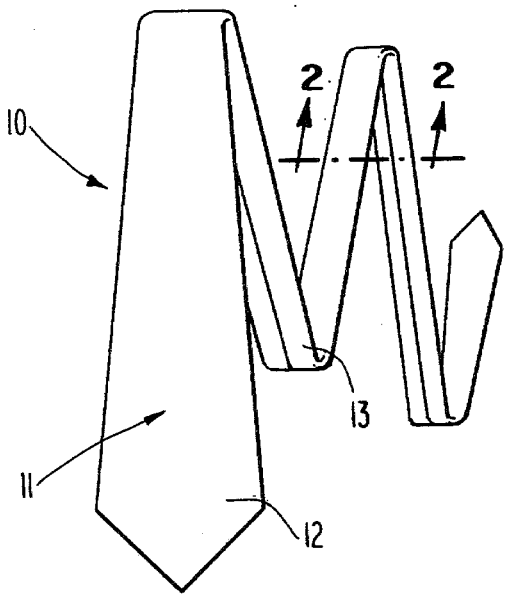
FIG. 1 is a perspective view of a necktie.

Referring now to FIG. 1, a necktie 10 is illustrated having the usual external shape and appearance, and having the usual casing or outer material 11. The casing 11 has an outer surface or face 12 and a back surface 13.

Figure 2:
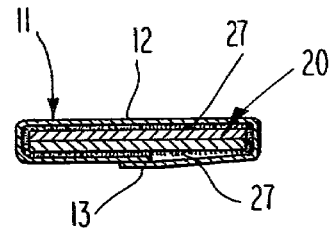
FIG. 2 is a cross-sectional view of the necktie of FIG. 1 taken along the line 2—2 of FIG. 1.

Referring now to FIG. 2, necktie 10 is shown as having interlining 20 positioned within casing 11. In the manufacture of necktie 10, interlining 20 is stitched (not shown) to the inside of the necktie, the casing is then reversed or turned to position lining 20 inside the necktie and pressed to form a finished necktie which is ready for sale and use. U.S. Pat. Nos. 3,426,360 and 3,562,814 clearly describe and illustrate the above fabrication of the necktie and are to that extent incorporated herein by this reference.

Figure 3:
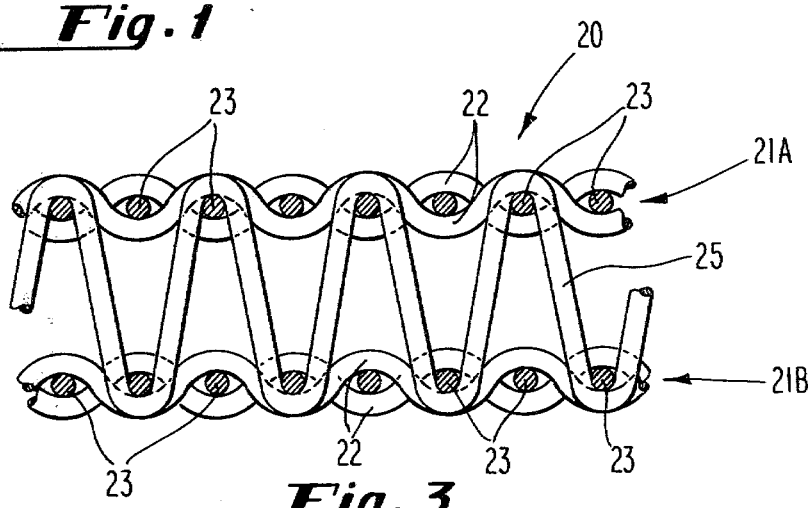
FIG. 3 shows on an enlarged scale, a fragmentary section through an edge portion of the necktie lining in a view similar to FIG. 2.
Figure 4:
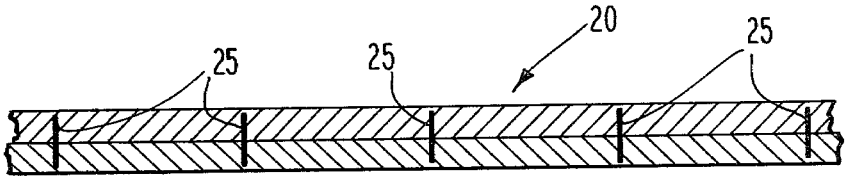
FIG. 4 is a fragmentary, sectional side elevation of the tie lining in a view similar to FIG. 2.

Referring now to FIG. 3 and FIG. 4, it can be seen that interlining 20 is comprised of a single interwoven double cloth fabric which consists of two plain woven fabric plys, 21A and 21B, each consisting of warp yarns 22 and filler yarns 23. First fabric ply 21A and second fabric ply 21B, are positioned one above the other with warp yarns 22 and filler yarns 23 of first ply 21A extending in the same direction as the corresponding yarns of second ply 21B. Interlining 20 is provided with several pluralities of binder yarns 25 which are woven together with the above first and second plys on a properly cammed loom, as is known in the art. Each binder yarn 25 alternatively engages each of the first and second fabric plys, in stressed condition, forming a highly resilient single interwoven double cloth fabric. As is shown in FIG. 4, the double cloth fabric is woven with binder threads 25 in every eighth course of warp yarns to form a single fabric utilized as interlining 20. It is to be understood that the manner of interweaving the binder threads and the first and second plys can be varied and, for example, the frequency with which binder yarns 25 engage the first and second fabric plys may be increased or decreased, either warp-wise, filler-wise, or in any combination thereof, as is known in the art.

The single interwoven double cloth fabric of interlining 20, as fabricated above, is a highly resilient fabric with excellent napping characteristics. As is shown in FIG. 2, interlining 20 has been brushed to form heavily napped outer tie lining surfaces 27. The napping of surfaces 27 yields roundness to the edges and fullness to the fabric not similarily achieved in conventional tie linings. In fact, interlining 20 may be heavily napped without destroying the fabric and therefor the density of the woven fabric plys may be reduced without sacrificing good bulk characteristics in the interlining.

The neckwear of the present invention contemplates an interlining fabricated of wool, polyester, wool blends, polyester blends, etc., as are known in the art.

The neckwear formed in accordance with the present invention is not only particularly attractive and practical in use, but should promote large cost savings in its manufacture since the manufacturing operations will take less time and will not necessitate the highly skilled and experienced labor which is required in the production of finished articles utilizing double layer linings.

It will be apparent from the foregoing that various modifications may be made in the materials of construction, and in their use and operation, without departing from the spirit and scope of the present invention as described in the specification and the appended claims.

What is claimed is:

1. Neckwear having a light-weight single interwoven double cloth fabric which has excellent resiliency and improved hand, stretching, and knotting characteristics, comprising:

a fabric casing folded longitudinally;

a single interwoven double cloth fabric within said fabric casing having two superimposed layers of plain woven fabric and a binder thread alternatively engaging each of said two superimposed layers.

2. Neckwear having a light-weight single interwoven double cloth fabric which has excellent resiliency and improved hand, stretching, and knotting characteristics as in claim 1, wherein said double cloth fabric is heavily napped on its outer surfaces to produce a lightweight lining haing good bulk.

3. Neckwear having a light-weight single interwoven double cloth fabric which has excellent resiliency and improved hand, stretching, and knotting characteristics as in claim 1, wherein each of said superimposed layers includes several courses of warp yarns, said binder thread alternatively engaging said superimposed layers in a plurality of said courses of said warp yarns.

4. Neckwear having a light-weight single interwoven double cloth fabric which has excellent resiliency and improved hand, stretching, and knotting characteristics as in claim 3, wherein said binder threads alternatively engage said superimposed layers in every eighth course of said warp yarns.

5. In a method of fabricating neckwear as in claim 1, to achieve roundness to the edges of said neckwear and a fullness of said neckwear not similarly achieved in conventional neckwear, the step comprising heavily napping the outer surface of said interwoven double cloth fabric whereby the bulk of said interwoven double cloth fabric is not destroyed.

* * * * *